US006461965B1

(12) United States Patent
Hunt et al.

(10) Patent No.: US 6,461,965 B1
(45) Date of Patent: Oct. 8, 2002

(54) METHOD FOR EFFECTING A FINISHING OPERATION ON A SEMICONDUCTOR WORKPIECE

(75) Inventors: Kyle P. Hunt, Dallas, TX (US); William R. Morrison, Dallas, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/061,811

(22) Filed: Jan. 31, 2002

(51) Int. Cl.[7] ..... H01L 21/461; H01L 21/302

(52) U.S. Cl. ..... 438/692; 438/690; 438/691; 438/745

(58) Field of Search ..... 438/692, 690, 438/691, 745, 754

(56) References Cited

U.S. PATENT DOCUMENTS 5,863,838 A * 1/1999 Farkas et al. ..... 438/693
5,916,412 A * 6/1999 Nakashiba et al. ..... 156/345
6,110,832 A * 8/2000 Morgan ..... 438/692
6,153,525 A * 11/2000 Hendricks et al. ..... 438/692
6,191,037 B1 * 2/2001 Robinson et al. ..... 438/690

* cited by examiner

*Primary Examiner*—Alexander Ghyka
(74) *Attorney, Agent, or Firm*—Jacqueline J. Garner; W. James Brady, III; Frederick J. Telecky, Jr.

(57) ABSTRACT

A method for effecting a finishing operation on a semiconductor workpiece situated in a finishing apparatus that includes a finishing tool configured for pressingly engaging the workpiece with a pressing force for abradingly removing material from the workpiece includes the steps of: (a) situating the finishing tool to operate against the workpiece; (b) operating the finishing tool with a pressing force to effect the abrading removal; (c) measuring at least one parameter associated with the finishing operation to determine at least one parametric value for the at least one parameter; (d) modulating the pressing force according to a predetermined relationship between the pressing force and the at least one parametric value; and (e) repeating steps (c) and (d) until the finishing operation is complete.

11 Claims, 4 Drawing Sheets

METHOD FOR EFFECTING A FINISHING OPERATION ON A SEMICONDUCTOR WORKPIECE

BACKGROUND OF THE INVENTION

The present invention is directed to semiconductor apparatus fabrication, and especially to effecting finishing operations with workpieces, such as semiconductor wafers.

A process often used for carrying out finishing operations with semiconductor workpieces such as semiconductor wafers is a chemical mechanical polishing (CMP) process. The process is sometimes referred to as chemical mechanical planarization and is also referred to in that context as CMP. For purposes of this application chemical mechanical polishing and chemical mechanical planarization are regarded as interchangeable terms describing substantially the same process.

During CMP processing certain film characteristics of surfaces being finished are known to cause excessive polishing with little down-force or slow platen speeds. Down-force and pressing force are terms used to describe the force with which a polishing or finishing tool is urged against a workpiece during finishing operations. Platen speed refers to speed of a tool platen holding a finishing tool, or refers to speed of a workpiece platen holding a workpiece, or refers to a resultant speed experienced between a finishing tool and a workpiece when both a tool platen and a workpiece platen are moved during finishing operations.

Films which exhibit a relatively high amount of polishing with little down-force or slow platen speeds are typically low dielectric constant (low-k) films. When such low-k films are subjected to polishing upon a semiconductor wafer they are prone to having some areas on the wafer polish much faster than other areas on the wafer. Certain slurry materials introduced between a finishing tool and a workpiece may also contribute to fast polishing areas, or hot spots. Fast-polishing areas, or hot spots, typically occur at or near the center of the workpiece but not exclusively so. Such hot spots often cause damage to features underlying the surface being finished.

Attempts have been made to provide for cooling of platens (workpiece platens, or tool platens or both platens) to avoid hot spots and thereby avoid uneven results of finishing operations. It has proven difficult to maintain a constant workpiece surface temperature through the thickness of the workpiece when the workpiece platen is cooled. When cooling the tool platen it proved difficult to maintain a constant workpiece surface temperature through the thickness of the tool (for example, the tool is commonly configured as a polishing pad).

A contrary condition working against the desire to cool the workpiece surface in order to avoid hot spots is a requirement for an elevated operating temperature range sufficient to promote acceptably rapid polishing rates. It has proven difficult to cool one or both platens sufficiently to avoid hot spots and still maintain the elevated temperatures that are required to sustain a reasonable polish rate.

There is a need for a method for effecting a finishing operation on a semiconductor workpiece that reduces localized heating of the workpiece.

SUMMARY OF THE INVENTION

The inventors have discovered that carrying out a finishing operation for a semiconductor workpiece, such as a semiconductor wafer, in a manner to provide for breaking up the polishing time by the finishing tool against the workpiece into higher down-force periods and lower down-force periods yields a more evenly finished end product than is provided using prior art finishing techniques in which a substantially constant down-force is exerted against the workpiece for the duration of the finishing process step. Using the novel method for finishing semiconductor workpieces disclosed herein, a manufacturer experiences fewer manifestations of product damage from hot spots than was attainable using prior art, constant down-force finishing techniques.

The variance of down-force by the finishing tool against the workpiece may be effected by several ways including, but not limited to lifting the finishing tool clear of the workpiece, varying down-force, or otherwise cycling or modulating down-force exerted by the finishing tool against the workpiece. Such modulation or interruption of down-force by the finishing tool against the workpiece permits, or at least encourages, cooling of the workpiece, cooling of the finishing tool, redistribution and cooling of slurry material between the finishing tool and the workpiece and other stabilizing phenomena between the finishing tool and the workpiece that promote even finishing of the workpiece during finishing operations. Planned transfer of a workpiece from one platen to another platen during finishing operations may be employed as a way to effect the desired interruption of down-force by the finishing tool against the workpiece. Such an occasion of changing workpiece platens also provides an opportunity to introduce other changes or interruptions to the finishing process to enhance the effects of varying down-force, such as introducing another slurry material between the finishing tool and the workpiece or establishing a different platen speed.

Depending upon a variety of factors (e.g., materials on the workpiece surface, slurry material employed, thickness of materials involved, or other factors), if the chosen adjustment to down-force is interruption of down-force as by lifting the finishing tool clear of the workpiece, the duration of an interruption of down-force may range from about 0.1 second to about 120 seconds. Time intervals of down-force interruptions need not be equal over the duration of a finishing operation. Also depending upon various and several factors, the number of interruptions during a finishing operation may range from one time to approximately 100 times.

A method for effecting a finishing operation on a semiconductor workpiece situated in a finishing apparatus that includes a finishing tool configured for pressingly engaging the workpiece with a pressing force for abradingly removing material from the workpiece includes the steps of: (a) situating the finishing tool to operate against the workpiece; (b) operating the finishing tool with a pressing force to effect the abrading removal; (c) measuring at least one parameter associated with the finishing operation to determine at least one parametric value for the at least one parameter; (d) modulating the pressing force according to a predetermined relationship between the pressing force and the at least one parametric value; and (e) repeating steps (c) and (d) until the finishing operation is complete.

The method of the present invention permits employment of aggressive polishing parameters (e.g., high platen speed, high down-force and abrasive slurry materials) that are required for high speed finishing without producing the hot spots caused by high temperatures ordinarily created by applying such aggressive finishing parameters. The method also encourages even distribution and cooling of slurry material between a tool and a workpiece in finishing operations.

Further objects and features of the present invention will be apparent from the following specification and claims when considered in connection with the accompanying drawings, in which like elements are labeled using like reference numerals in the various figures, illustrating the preferred embodiments of the invention.

DETAILED DESCRIPTION OF THE PREFERRED EMBODIMENT

Figure 1:
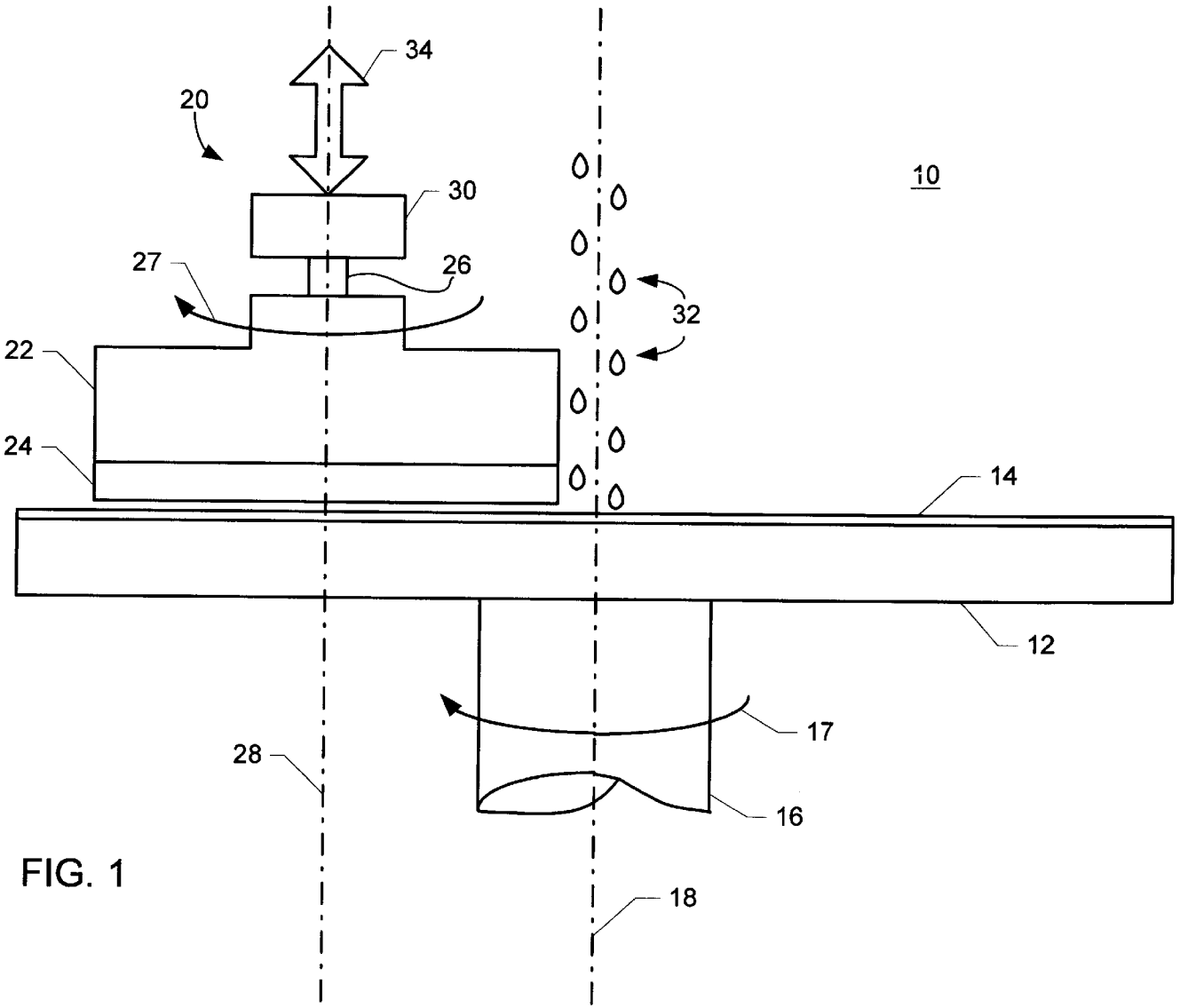
FIG. 1 is a schematic elevation view of a portion of a first representative finishing apparatus with which the present invention is useful.

FIG. 1 is a schematic elevation view of a portion of a first representative finishing apparatus with which the present invention is useful. In FIG. 1, a finishing apparatus 10 includes a workpiece fixture or platen 12 supporting a workpiece 14 on a workpiece drive member represented by a workpiece drive shaft 16. Workpiece drive shaft 16 may be coupled with a drive mechanism such as a motor (not shown in FIG. 1) for rotating workpiece platen 12 about a workpiece axis 18, as indicated by arrow 17. Direction of rotation of workpiece platen 12 about workpiece axis 18 may be varied from the direction indicated in FIG. 1, and may include oscillatory rotation about workpiece axis 18. Apparatus 10 also includes a finishing tool assembly 20. Finishing tool assembly 20 includes a tool fixture or platen 22 supporting a finishing tool 24 on a tool drive member represented by a tool drive shaft 26. Tool drive shaft 26 is coupled with a drive mechanism such as a tool drive motor 30 for rotating tool platen 22 about a tool axis 28, as indicated by arrow 27. Direction of rotation of tool platen 22 about tool axis 28 may be varied from the direction indicated in FIG. 1, and may include oscillatory rotation about tool axis 28. Tool axis 28 is illustrated in FIG. 1 in the preferred embodiment of finishing apparatus 10 as being displaced from (i.e., not coincident with) workpiece axis 18. In an alternative embodiment of finishing apparatus 10 tool axis 28 and workpiece axis 18 may be coincident.

Finishing tool assembly 20 may be moved substantially along tool axis 28 to increase or decrease down-force or pressing force exerted by finishing tool 24 against workpiece 14, as indicated by arrow 34. Slurry material 32 is introduced to finishing apparatus 30 between finishing tool 24 and workpiece 14 preferably generally along workpiece axis 18. In such an arrangement centrifugal forces established by rotating workpiece 14 about workpiece axis 18 will urge slurry material 32 to a position between finishing tool 24 and workpiece 14 to enhance finishing effects by finishing tool 24 upon workpiece 14.

Figure 2:
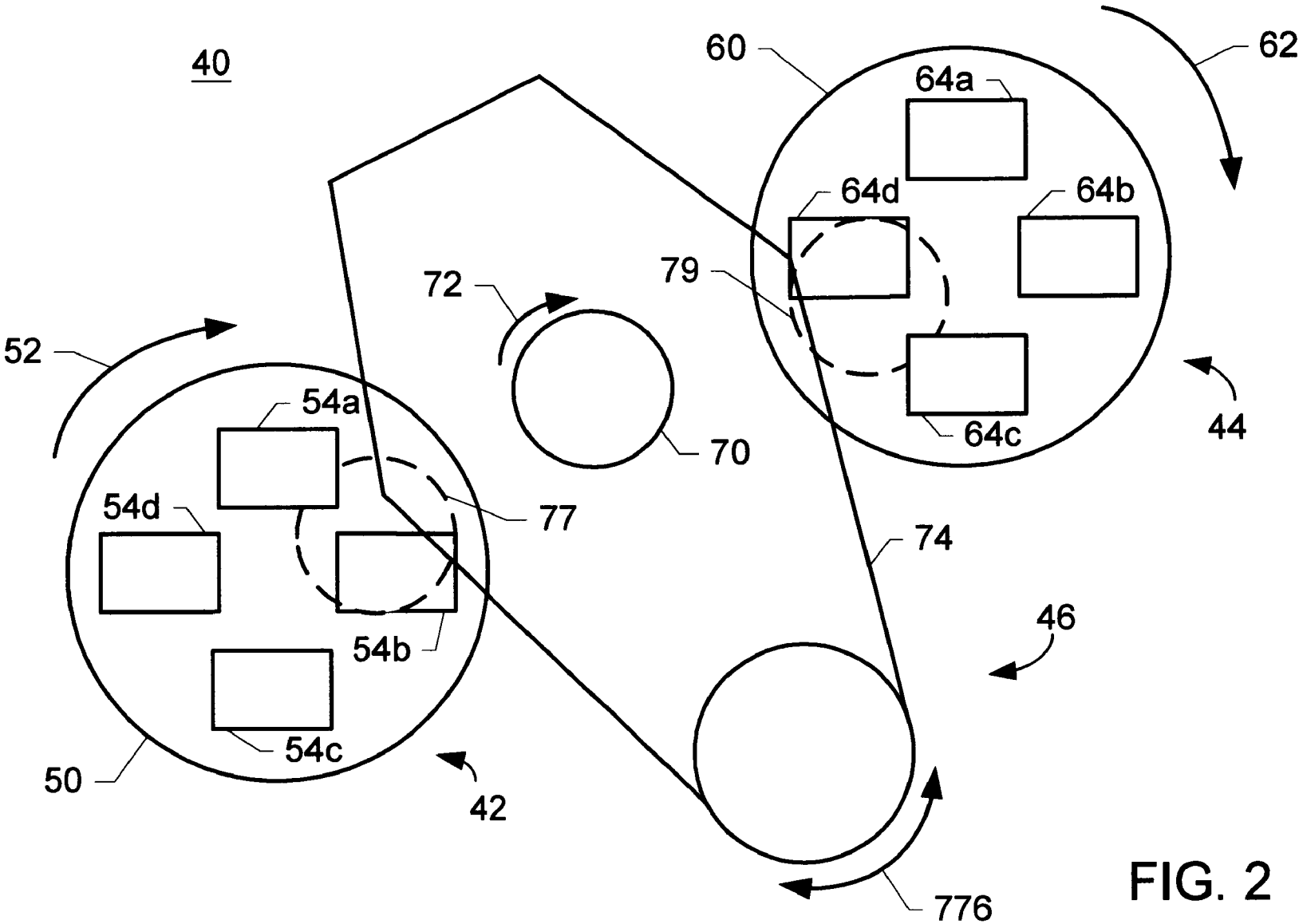
FIG. 2 is a schematic top plan view of a second representative finishing apparatus with which the present invention is useful.

FIG. 2 is a schematic top plan view of a second representative finishing apparatus with which the present invention is useful. In FIG. 2, a finishing apparatus 40 includes a first workpiece assembly 42, a second workpiece assembly 44 and a finishing tool assembly 46. First workpiece assembly 42 includes a first workpiece fixture or platen 50 configured for rotation in a direction indicated by arrow 52. Direction of rotation of first workpiece platen 50 may be varied from the direction indicated in FIG. 2, and may include oscillatory rotation. Workpieces 54*a*, 54*b*, 54*c*, 54*d* are fixedly situated with first workpiece platen 50. Second workpiece assembly 44 includes a second workpiece fixture or platen 60 configured for rotation in a direction indicated by arrow 62. Direction of rotation of second workpiece platen 60 may be varied from the direction indicated in FIG. 2, and may include oscillatory rotation. Workpieces 64*a*, 64*b*, 64*c*, 64*d* are fixedly situated with second workpiece platen 60.

Finishing tool assembly 46 includes a finishing tool 70 configured for rotation in a direction indicated by arrow 72. Direction of rotation of finishing tool 70 may be varied from the direction indicated in FIG. 2, and may include oscillatory rotation. Finishing tool 70 is connected with or mounted to a swing arm 74 that is configured for rotational movement as indicated by arrow 76 to selectively situate finishing tool 70 at a first operating locus 77 or at a second operating locus 79. Finishing tool 70 is configured for movement toward or away from workpiece platens 50, 60 to increase or decrease down-force or pressing force exerted by finishing tool 70 against workpiece platens 50, 60 (not illustrated in detail in FIG. 2). When finishing tool 70 is at first operating locus 77, finishing tool 70 is in position to effect finishing operations on substrates 54*a*, 54*b*, 54*c*, 54*d* as they rotatingly advance past finishing tool 70. When finishing tool 70 is at second operating locus 79, finishing tool 70 is in position to effect finishing operations on substrates 64*a*, 64*b*, 64*c*, 64*d* as they rotatingly advance past finishing tool 70.

Figure 3:
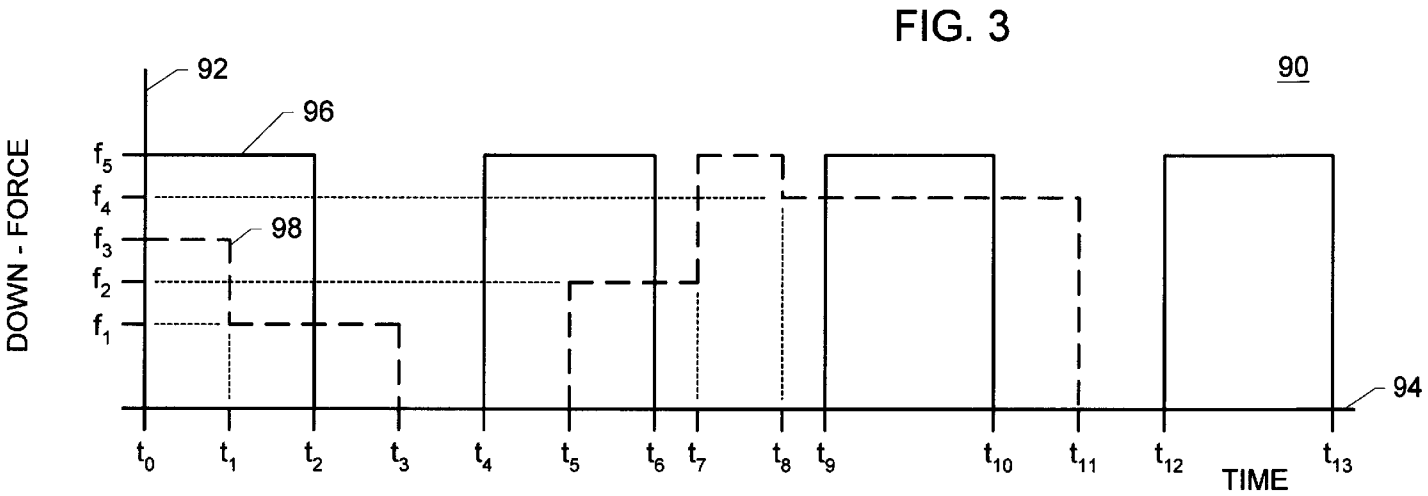
FIG. 3 is a first graphic representation of how pressing force may be varied over time according to the present invention.

FIG. 3 is a first graphic representation of how pressing force may be varied over time according to the present invention. In FIG. 3, a graphic plot 90 illustrates pressing force, or down-force on an axis 92 as a function of time indicated on an axis 94. A first relationship of down-force as a function of time is indicated in solid-line curve 96. A second relationship of down-force as a function of time is indicated in dashed-line curve 98.

Solid-line curve 96 indicates a representative application of down-force by which down-force varies in substantially equal periods between a predetermined down-force $f_5$ and zero. Thus, curve 96 indicates down-force at a force level $f_5$ from time $t_0$ until time $t_2$, at force level zero from time $t_2$ to time $t_4$, at a force level $f_5$ from time $t_4$ until time $t_6$, at force level zero from time $t_6$ to time $t_9$, at a force level $f_5$ from time $t_9$ until time $t_{10}$, at force level zero from time $t_{10}$ to time $t_{12}$, and at a force level $f_5$ from time $t_{12}$ until time $t_{13}$. Time intervals $t_0$–$t_2$, $t_2$–$t_4$, $t_4$–$t_6$, $t_6$–$t_9$, $t_9$–$t_{10}$, $t_{10}$–$t_{12}$, $t_{12}$–$t_{13}$ are of substantially equal duration.

Dashed-line curve 98 indicates a second representative application of down-force by which down-force varies in unequal time intervals among various down-force levels. Thus, curve 96 indicates down-force at a force level $f_3$ from time $t_0$ until time $t_1$, at force level $f_1$ from time $t_1$ to time $t_3$, at force level zero from time $t_3$ until time $t_5$, at force level $f_2$ from time $t_5$ to time $t_7$, at a force level $f_5$ from time $t_7$ until time $t_8$, at force level $f_4$ from time $t_8$ to time $t_{11}$, and at force level zero from time $t_{11}$ until time $t_{13}$. Time intervals $t_0$–$t_1$, $t_1$–$t_3$, $t_3$–$t_5$, $t_5$–$t_7$, $t_7$–$t_8$, $t_8$–$t_{11}$, $t_{11}$–$t_{13}$ are of unequal duration.

Figure 4:
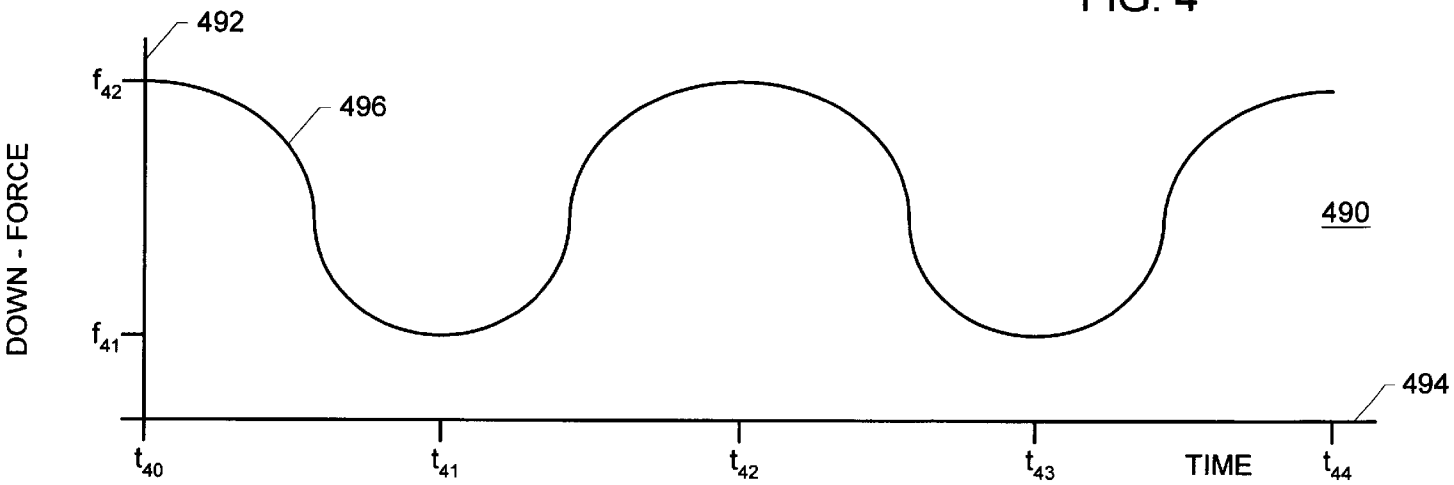
FIG. 4 is a second graphic representation of how pressing force may be varied over time according to the present invention.

FIG. 4 is a second graphic representation of how pressing force may be varied over time according to the present invention. In FIG. 4, a graphic plot 490 illustrates pressing force, or down-force on an axis 492 as a function of time indicated on an axis 494. A curve 496 indicates a third representative application of down-force by which down-force is modulated in time among various down-force levels. Thus, curve 496 indicates down-force at a force level $f_{42}$ at a time $t_{40}$. Down-force is continuously smoothly varied, or modulated from force level $f_{42}$ to a force level $f_{41}$ at a time $t_{41}$. Down-force is further smoothly varied, or modulated from force $f_{41}$ at time $t_{41}$ to a force level $f_{42}$ at time $t_{42}$, further varied to force level $f_{41}$ at time $t_{43}$ and still further varied to force level $f_{42}$ at time $t_{44}$. Curve 496 illustrates a modulated down-force as a function of time that is substantially an analog version of curve 96 (FIG. 3) in that peak values $f_{41}$, $f_{42}$ are substantially constant and time intervals $t_{40}$–$t_{41}$, $t_{41}$–$t_{42}$, $t_{42}$–$t_{43}$, $t_{43}$–$t_{44}$ between peak values are substantially equal in duration. The peak force levels may vary from force levels $f_{41}$, $f_{42}$ and time intervals between peak force levels may be unequal (e.g., as represented by curve 98; FIG. 3). Modulation of curve 496 may be effected according to a relation with an associated finishing process being carried out in applying down-force against a workpiece. Such modulation of down-force in effecting an associated finishing process may be expressed in one or more of an algorithmic relation, a relation with an observed parameter, a relation with a look up table, a relation with empirical data, or relations with other stored or observed or derived information or data. For example, temperature observed or detected at the polishing or finishing site on the workpiece being processed may determine the variation of down-force over time. Observation and detection of drive current of the motor driving the finishing tool is another example of an observed parameter that may be employed for monitoring the finishing process in order to properly vary the down-force used for the finishing process. These parameters and other parameters may be employed in constructing tables or time schedules for use in determining variance of down-force over time during a particular process.

Figure 5:
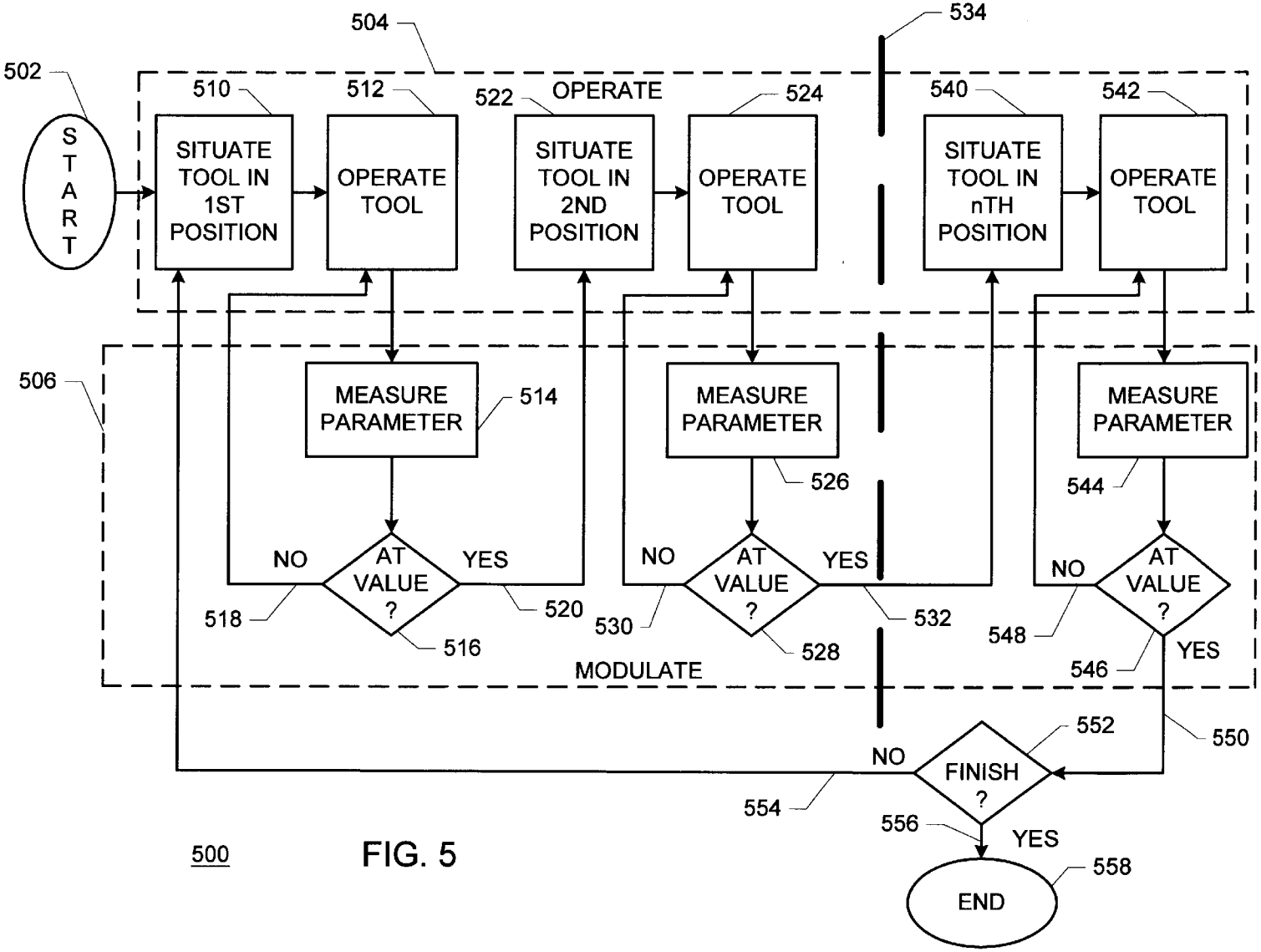
FIG. 5 is a flow chart illustrating the present invention.

FIG. 5 is a flow chart illustrating the present invention. In FIG. 5, a method 500 for effecting a finishing operation on a semiconductor workpiece begins at a start locus 502. The semiconductor workpiece is situated in a finishing apparatus that includes a finishing tool configured for pressingly engaging the workpiece with a pressing force, or down-force, for abradingly removing material from the workpiece. Generally, method 500 involves iterative performance of OPERATE steps, as indicated by a dotted-line box 504, and MODULATE steps, as indicated by a dotted-line box 506. Method 500 proceeds from start locus 502 to situating the finishing tool in a first position to operate against the workpiece, as indicated by a block 510. Method 500 continues with operating the finishing tool against the workpiece with a pressing force to effect the abrading removal, as indicated by a block 512. Method 500 continues with measuring at least one parameter associated with the finishing operation to determine at least one parametric value for the at least one parameter, as indicated by a block 514. Method 500 modulates the pressing force according to the measured parameter. This modulation is represented in FIG. 5 by posing a query whether the measured parameter (block 514) has attained a predetermined value, as indicated by a query block 516. If the parameter measured has not attained the predetermined value, method 500 proceeds via NO response line 518 to return method 500 to operating the finishing tool against the workpiece, as indicated by block 512, and the parameter is measured and checked again according to blocks 514, 516. If the parameter measured has attained the predetermined value, method 500 proceeds via YES response line 520 to situate the finishing tool in a second position to operate against the workpiece, as indicated by a block 522. Method 500 continues with operating the finishing tool against the workpiece with a pressing force to effect the abrading removal, as indicated by a block 524. Method 500 continues with measuring at least one parameter associated with the finishing operation to determine at least one parametric value for the at least one parameter, as indicated by a block 526. The parameter measured according to block 526 may be the same parameter or a different parameter than the parameter measured according to block 514. Method 500 modulates the pressing force according to the measured parameter. This modulation is represented in FIG. 5 by posing a query whether the measured parameter (block 526) has attained a predetermined value, as indicated by a query block 528. If the parameter measured has not attained the predetermined value, method 500 proceeds via NO response line 530 to return method 500 to operating the finishing tool against the workpiece, as indicated by block 524, and the parameter is measured and checked again according to blocks 526, 528. If the parameter measured has attained the predetermined value, method 500 proceeds via YES response line 532. A heavy dashed line 534 indicates that method 500 is iterative in nature and will continue until the process with which the operation of method 500 is related is complete. Determination of completion of the operation may be determined by one or more parameters not discussed in detail herein.

Thus, method 500 continues with situating to situate the finishing tool in an nth position to operate against the workpiece, as indicated by a block 540. Method 500 continues with operating the finishing tool against the workpiece with a pressing force to effect the abrading removal, as indicated by a block 542. Method 500 continues with measuring at least one parameter associated with the finishing operation to determine at least one parametric value for the at least one parameter, as indicated by a block 544. The parameter measured according to block 544 may be the same parameter or a different parameter than the parameter or parameters measured according to blocks 514, 526. Method 500 modulates the pressing force according to the measured parameter. This modulation is represented in FIG. 5 by posing a query whether the measured parameter (block 544) has attained a predetermined value, as indicated by a query block 546. If the parameter measured has not attained the predetermined value, method 500 proceeds via NO response line 548 to return method 500 to operating the finishing tool against the workpiece, as indicated by block 542, and the parameter is measured and checked again according to blocks 544, 546. If the parameter measured has attained the predetermined value, method 500 proceeds via YES response line 550 to a query block 552.

A query is posed: "Is the finishing operation complete?", as indicated by query block 552. If the finishing operation is not complete, method 500 proceeds via NO response line 554 to return method 500 to situate the finishing tool in the first position, as indicated by block 542. Method 500 then continues iteratively as described above until a check is made again whether the finishing operation is complete, as indicated by query block 552. If the finishing operation is complete, method 500 proceeds from query block 554 via YES response line 556 and terminates, as indicated by an end locus 558.

The check whether the finishing operation is complete (query block 552) may be made after any of the parameter checks (blocks 516, 528, 546). That is to say that any number of iterations of positioning the finishing tool and operating the tool against the workpiece may be effected in each cycle of method 500 to be carried out before determining whether the finishing operation is complete (block 552).

As mentioned earlier, modulation (block 506) may be effected according to a relation with an associated finishing process being carried out in applying down-force. Such a relation with an associated finishing process may be expressed in one or more of an algorithmic relation, a relation with an observed parameter, a relation with a look up table, a relation with empirical data, or relations with other stored or observed or derived information or data. For example, temperature observed or detected at the polishing or finishing site on the workpiece being processed may drive the variation of down-force over time. Observation and detection of drive current of the motor driving the finishing tool is another example of an observed parameter that may be employed for monitoring. These parameters and other parameters may be employed in constructing tables or time schedules for use in determining variance of down-force over time during a particular finishing process. Alternatively, modulation (block 506) may be effected without regard to a parameter at all but may instead be effected as a timed operation regardless of physical phenomena extant on the workpiece. Such a simplified time-based arrangement may be useful when a process is well understood and timed variations of down-force suffice to yield desired product quality. The additional expense and complexity required for parameter measurement and monitoring with an associated feedback control mechanism or circuit may be avoided with such a simplified time-based system. FIG. 5 represent such a simplified system in presenting large dotted-line boxes 504 (OPERATE) and 506 (MODULATE). Modulation may be carried out in such a simplified time-based system simply by measuring elapsed time (blocks 514, 526, 544) as a parameter for determining when to change (blocks 516, 528, 546) tool positions (blocks 510, 522, 540).

It is to be understood that, while the detailed drawings and specific examples given describe preferred embodiments of the invention, they are for the purpose of illustration only, that the apparatus and method of the invention are not limited to the precise details and conditions disclosed and that various changes may be made therein without departing from the spirit of the invention which is defined by the following claims.

What is claimed is:

1. A method for effecting a finishing operation on a semiconductor workpiece; said workpiece being situated with a fixture; a finishing tool being configured for cooperating with said fixture to pressingly engage said workpiece with a pressing force for abradingly removing material from said workpiece; the method comprising the steps of:

(a) situating said finishing tool in a first orientation to operate against said workpiece with a first pressing force;

(b) operating said finishing tool in said first orientation to effect said abrading removal for a first finishing interval;

(c) situating said finishing tool in a second orientation to operate against said workpiece with a second pressing force;

(d) operating said finishing tool in said second orientation for a second finishing interval; and (e) repeating steps (a) through (d) until said finishing operation is complete.

2. A method for effecting a finishing operation on a semiconductor workpiece as recited in claim 1 wherein said second pressing force is less than said first pressing force.

3. A method for effecting a finishing operation on a semiconductor workpiece as recited in claim 2 wherein said second pressing force is substantially zero.

4. A method for effecting a finishing operation on a semiconductor workpiece as recited in claim 1 wherein said second pressing force is greater than said first pressing force.

5. A method for effecting a finishing operation on a semiconductor workpiece as recited in claim 1 wherein said first finishing interval and said second finishing interval are varied according to a predetermined pattern for selected iterations of performing step e).

6. A method for effecting a finishing operation on a semiconductor workpiece; said workpiece being situated in a finishing apparatus; said finishing apparatus including a finishing tool configured for pressingly engaging said workpiece with a pressing force for abradingly removing material from said workpiece; the method comprising the steps of:

a) situating said finishing tool in a first orientation with respect to said workpiece;

b) operating said finishing tool in said first orientation to apply a first pressing force against said workpiece until a first parameter achieves a first value;

c) situating said finishing tool in a second orientation with respect to said workpiece;

d) operating said finishing tool in said second orientation to apply a second pressing force against said workpiece until a second parameter achieves a second value; and e) repeating steps (a) through (d) until said finishing operation is complete.

7. A method for effecting a finishing operation on a semiconductor workpiece as recited in claim 6 wherein said second pressing force is less than said first pressing force.

8. A method for effecting a finishing operation on a semiconductor workpiece as recited in claim 7 wherein said second pressing force is substantially zero.

9. A method for effecting a finishing operation on a semiconductor workpiece as recited in claim 6 wherein said second pressing force is greater than said first pressing force.

10. A method for effecting a finishing operation on a semiconductor workpiece as recited in claim 6 wherein said first finishing force and said second finishing force are varied according to a predetermined pattern for selected iterations of performing step (e).

11. A method for effecting a finishing operation on a semiconductor workpiece; said workpiece being situated in a finishing apparatus; said finishing apparatus including a finishing tool configured for pressingly engaging said workpiece with a pressing force for abradingly removing material from said workpiece; the method comprising the steps of:

a) situating said finishing tool to operate against said workpiece;

b) operating said finishing tool with a pressing force to effect said abrading removal;

c) measuring at least one parameter associated with said finishing operation to determine at least one parametric value for said at least one parameter;

d) modulating said pressing force according to a predetermined relationship between said pressing force and said at least one parametric value; and e) repeating steps (c) and (d) until said finishing operation is complete.

* * * * *